United States Patent [19]

Williamson

[11] Patent Number: 4,877,354

[45] Date of Patent: Oct. 31, 1989

[54] PIPELINE ANODE

[75] Inventor: George C. Williamson, Wylie, Tex.

[73] Assignee: Atlantic Richfield Company, Los Angeles, Calif.

[21] Appl. No.: 217,255

[22] Filed: Jul. 11, 1988

[51] Int. Cl.[4] ..... F16L 1/04

[52] U.S. Cl. ..... 405/157; 204/148; 204/197; 405/154; 138/172

[58] Field of Search ..... 405/172, 168; 204/148, 204/197; 138/103, 110, 172

[56] References Cited

U.S. PATENT DOCUMENTS

| | | | |
|---|---|---|---|
| 3,251,427 | 5/1966 | Ewing | 204/148 X |
| 3,623,968 | 11/1971 | Bohne | 204/148 X |
| 3,994,795 | 11/1976 | Kurr | 204/197 |
| 4,300,598 | 11/1981 | Royer et al. | 138/103 X |
| 4,364,692 | 12/1982 | Kyriakides et al. | 405/168 |
| 4,487,230 | 12/1984 | Anthony | 405/172 X |
| 4,620,818 | 11/1986 | Langner | 405/169 |
| 4,647,255 | 3/1987 | Pow | 405/168 |

*Primary Examiner*—Dennis L. Taylor

*Attorney, Agent, or Firm*—John R. Casperson; F. Lindsey Scott; Roderick W. MacDonald

[57] ABSTRACT

Providing circumferential grooves in bracelet-type anodes on a pipeline provides for preservation of anode effectiveness during bending of the pipeline, such as in reeling operations.

12 Claims, 1 Drawing Sheet

PIPELINE ANODE

BACKGROUND OF THE INVENTION

In one aspect, this invention relates to the design of a cast on pipe anode. In another aspect, the invention relates to a pipeline havig anodes thereon. In another aspect, the invention relates to a method for laying a pipeline. In other aspects, the invention relates to methods for providing a pipe with cast one anodes.

Sacrificial anodes are commonly used to cathodically protect steel structures, for example, steel pipelines. One type of anode used on pipelines is cast directly onto the pipe sections before the sections are connected to form the pipeline.

Pre-cast on anodes are in use on pipelines that are installed by a dragging or towing operations. However, pre-cast on anodes are not used on pipelines that are installed by reel barge methods. In such operations, the pipelines are stored on large reels and it is believed that cast on anodes of previously known designs would become damaged by cracking and spalling to too great an extent during the coiling and uncoiling operations to provide adequate protection. The problem of cracking and spalling would be exacerbated due to the brittleness of known suitable anode materials. This brittleness cannot be alleviated by alloy changes or the addition of other elements because anode alloys must meet strict specifications as to chemical composition in order to be effective. Most alloys and elements that would promote ductility would be cathodic to the anode material and would thereby significantly reduce current efficiency and the effectiveness of the anode.

Offshore, pipelining operations involve the use of reel barges. The pipeline is unreeled during the laying operation of the pipeline. The bottleneck for the operation is the installation of the anodes on the pipeline. Each anode delays laying progress for in the range of from about 20 to 45 minutes. Successful cast on anodes which could be used on a reel barge could revolutionize pipeline laying methods. The development of such anodes would make a semicontinuous operation a fully continuous one and result in great time and labor savings.

OBJECTS OF THE INVENTION

It is an object of this invention to provide a design for a new type of cast on anode.

It is another object of this invention to provide a pipeline having a newly designed cast on anode.

It is another object of this invention to provide a cast on anode which can be successfully used in a pipelining operation in which the pipeline containing the anode is coiled and uncoiled from a reel.

Another object of the invention is to provide methods for fabricating a pipeline having cast on anodes.

SUMMARY OF THE INVENTION

In one embodiment of the invention, an iron-containing tubular member is provided which is suitable for forming a pipeline. The iron-containing tubular member has an interior surface and an exterior surface and an anode positioned on the exterior surface. The anode has an interior surface which contacts the exterior surface of the iron-containing tubular member. The exterior surface of the anode is characterized by at least one groove which extends generally circumferentially at least partly around the anode. The groove functions as a crack initiator or promoter which intentionally directs any crack propagation generally circumferentially during the coiling and uncoiling operations of the pipeline.

In another embodiment of the invention, an iron-containing tubular member or pipe having a plurality of anodes positioned thereon, said anodes being provided with generally circumferentially-extending grooves at longitudinally spaced apart positions, is provided in coiled form on a reel. The pipe is drawn from the reel and the unreeled pipe having the anodes positioned thereon is positioned along a pipeline pathway. In this manner, the pipeline is provided with cathodic protection without the necessity of installing the anodes on site or connecting short pipeline sections during the pipe laying operation. It is believed that the circumferentially extending grooves will prevent excessive loss of anode material and allow the pipe to be coiled and uncoiled while the anodes remain integrally bonded to the pipe.

In two other embodiments of the invention, there are provided methods for producing the crack promoters or controllers in the anode. In a first embodiment, the crack initiators or controllers can be machined into conventional cast on anodes in an operation following the casting. In a second embodiment, the cast on anodes with crack initiators or controllers can be manufactured during the casting operation by using a specifically designed mold.

BRIEF DESCRIPTION OF THE DRAWING

FIG. 3 is a schematic representation of certain method steps which can be practiced in an embodiment of the invention.

FIG. 4 is a schematic representation of certain method steps that can be practiced in accordance with another embodiment of the invention.

DETAILED DESCRIPTION OF THE INVENTION

The anode design according to the invention could be used in environments currently served by conventional anodes. However, the anode design will find generally high utility where the member requiring cathodic protection is subjected to bending during fabrication, storage, installation, or use. The invention will probably find greatest utility in providing cathodic protection to pipelines, generally those pipelines which are tubularly shaped and contain iron.

Although the invention will be useful in situations in which the anode is positioned by techniques other than casting, it is expected that the invention will have greatest applicability and usefulness in conjunction with cast on anodes. Most cast on anodes are made of or contain zinc, which is a very common anode material. Zinc also has a relatively low melting point when compared with other metals. For iron-containing pipelines, such as steel, it is important to minimize thermal damage to the metallurgical structure of the steel during the casting on operation to provide the anode. Although most cast on anodes are zinc, the new anode design according to the invention should also be effective with other anode materials such as aluminum, magnesium, and alloys containing zinc, aluminum or magnesium.

Cathodic protection systems that use sacrificial anodes require certain amounts of anode mass to provide adequate life. An advantage of the newly designed anode is that it allows cast on anodes to be manufactured with a high metal mass. The newly designed anode allows cast on anodes to be made longer without cracking or spalling off during reeling operations. The additional length helps increase the available mass of anode material on the pipeline since thickness is usually limited by the pipe handling equipment. If the anodes are too thick, they will not fit through conventional reel barge equipment. One major benefit of the newly designed cast on anode is that it makes pre-cast on anode technology applicable to reel barge operations. Significant cost saving should be realized while using this method to lay offshore pipelines. Furthermore, the invention provides an advantage over conventional anode bracelets that require a brazing operation to connect electrical wires. The need for brazing is obviated. The possibility that wire connections may be detached while passing through offshore pipe laying equipment is also obviated. Additionally, the new anode design technology can convert a semicontinuous pipe laying operation into a fully continuous one. It is estimated that pipeline laying times can be reduced by a large factor.

Figure 1:
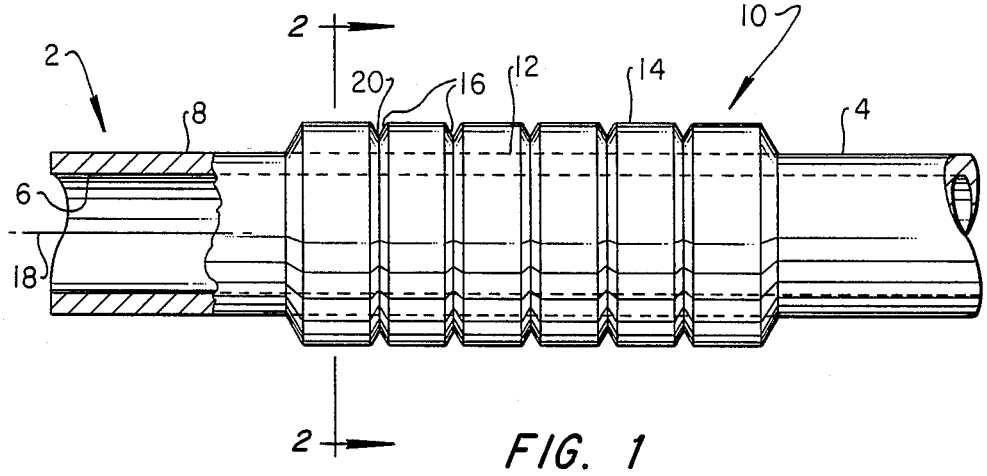
FIG. 1 is a pictorial representation of a section of a pipeline having an inventive anode positioned thereon.
Figure 2:
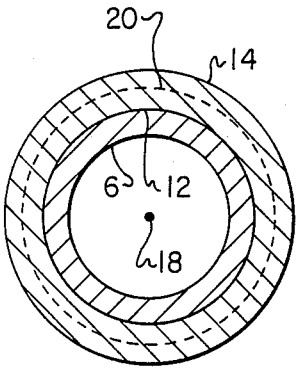
FIG. 2 is a cross sectional view of the pipeline shown in FIG. 1 when viewed along the indicated lines.

With reference to FIG. 1, a pipeline section illustrated generally by the reference numeral 2 is formed by a iron-containing tubular member 4 which has an interior surface 6 and an exterior surface 8. An anode called out generally by the reference numeral 10 is positioned on the exterior surface 8 of the iron-containing tubular member 4. The anode has an interior surface 12, illustrated by the dashed line in FIG. 1, which contacts the exterior surface 8 of the iron-containing tubular member 4. Preferably, the contacting is brought about by casting the anode in molten form onto the tubular member and allowing solidification to occur. The anode has an exterior surface 14 which is preferably (except for the hereinafter described grooves) generally cylindrically shaped. The anode 10 thus preferably has an overall generally tubular shape. The anode further is preferably beveled at each end to avoid hang-ups on handling machinery. The exterior surface 14 of the anode 10 is characterized by at least one generally circumferentially extending groove 16. Preferably, a plurality of generally circumferentially extending grooves 16 are longitudinally spaced apart along the exterior surface 14 of the anode. Generally speaking, the anode will contain elements selected from the group consisting of zinc, aluminum and magnesium to provide the iron-containing tubular member with a desirable degree of cathodic protection.

The thickness of the anode can be varied to obtain the appropriate degree of cathodic protection without interfering with pipe laying machinery by those skilled in the art. As a general rule, the anode will have a maximum thickness, as measured radially between the interior surface 12 of the anode and the exterior surface 14 of the anode which is in the range of from about 2 percent to about 30 percent of the distance as measured radially between a longitudinal axis 18 of the tubular member and the outer surface 14 of the anode, and a reduced thickness, as measured radially between the interior surface 12 of the anode and the exterior surface of the anode in a bottom 20 of one of the grooves 16, which is in the range of from about 10 percent to about 98 percent of said maximum thickness. Usually, the reduced thickness will be in the range of from about 50 percent to about 95 percent of the maximum thickness. The anode can have any desired length. Usually, however, the length of the anode, as measured in a direction parallel to the longitudinal axis 18 of the tubular member will range from about 1 to about 20 times to aforementioned radial distance between the longitudinal axis 18 and the outer surface 14 of the anode 10 at a generally cylindrical portion 14 of the anode.

The anode can be provided with any number of grooves. Generally, from about 1 to about 20 grooves will be longitudinally spaced apart along the length of the anode, usually in the range of about 3 to about 12 grooves. The grooves will generally be spaced apart at a distance in the range of from about 0.1 to about 10 times the radial distance between the longitudinal axis 18 and the outer surface 14, usually in the range of from about 0.2 to about 2 times said radial distance, and preferably in the range of about 0.3 to about 1 times the radial distance. Greater bending of the pipeline requires that the grooves be relatively closer together.

It is believed that most any groove will perform as a stress concentrator to cause preferential cracking of the anode in the groove. Generally speaking however, it is believed that the grooves will have a width, as measured parallel to the longitudinal axis 18 of the tubular member 4 which is in the range of from about 0.1 to about 10 percent of the distance between the longitudinal axis 18 of the tubular member and the outer surface 14 of the anode at one of the generally cylindrical portions in defining the maximum thickness of the anode. Preferably, the grooves completely encircle the anode generally circumferentially with respect to the tubular shape of the anode.

In the use of one embodiment of the invention, a supply of pipe 100 of the type illustrated by the FIGURES is provided on a reel 101 and can be characterized as an ironcontaining pipe havig a plurality of generally ring or band shaped sacrificial anodes 102 positioned thereon at generally longitudinally spaced apart positions. The pipe 100 is unreeled and positioned in the pipeline pathway 104. The cracks which form in the anode material during the reeling or unreeling of the pipe tend to occur in the anode grooves which cause stress concentrations during the reeling and unreeling operations performed on the pipe.

As mentioned in the summary of the invention, it is believed to be a simple matter to make various embodiments of the invention either by cutting a generally circumferentially extending groove in a cast on anode with a cutting tool means 106 or by casting the anode on pipe using a special mold means 108 so as to provide the generally circumferentially extending grooves. It is believed that best results will be obtained where the anode is cast onto the pipe so as to provide a metallurgical bond between the anode and the pipe. The pipe 100 can be provided from a conventional source 110.

While various embodiments of the invention have been described herein, the invention is not to be construed as so limited, except to the extent that such limitations are found in the claims.

What is claimed is:

1. Apparatus comprising an iron-containing tubular member having an interior surface and an exterior surface, said iron-containing tubular member having an anode positioned on said exterior surface, said anode having an interior surface contacting the exterior surface of the iron-containing tubular member and an exterior surface characterized by a plurality of generally circumferentially extending grooves longitudinally spaced apart on the exterior surface of said anode to direct crack propagation in said anode in a generally circumferentially direction.

2. An appartus as in claim 1 wherein the anode is generally tubularly shaped and the exterior surface of said anode is generally cylindrically shaped, and said plurality of generally circumferentially extending grooves number in the range of from about 3 to about 12.

3. An apparatus as in claim 2 wherein the anode contains an element selected from the group consisting of zinc, aluminum and magnesium, to provide the ironcontaining tubular member with cathodic protection.

4. An apparatus as in claim 3 wherein the anode has a maximum thickness, as measured radially between the interior surface of the anode and the exterior surface of the anode, which is in the range of from about two percent to about twenty percent of the distance as measured radially between the longitudinal axis of the tubular member and the outer surface of the anode, and a reduced thickness, as measured radially between the interior surface of the anode and the exterior surface of the anode in at least one of the grooves which is in the range of from about ten percent to about ninety-eight percent of said maximum thickness.

5. An apparatus as in claim 4 wherein the reduced thickness is in the range of from about fifty percent to about ninety-five percent of the maximum thickness.

6. An apparatus as in claim 5 wherein the anode has a length, as measured in the a direction parallel to the longitudinal axis of the iron-containing tubular member, ranging from about one to about twenty times the radial distance between the longitudinal axis of the tubular member and the outer surface of the anode at the maximum thickness of the anode, and said plurality of generally circumferentially extending grooves are spaced apart at a distance in the range of from about 0.2 to about 2 times the radial distance between the longitudinal axis of the tubular member and the outer surface of the anode at the maximum thickness of the anode.

7. An apparatus as in claim 6 wherein at least one of said plurality of grooves has a width, as measured parallel to the longitudinal axis of the tubular member, in the range of from about 0.1 to about 10 percent of the distance between the longitudinal axis of the tubular member and the outer surface of the anode at the maximum thickness thereof.

8. An apparatus as in claim 7 wherein at least one of said plurality of grooves extends generally circumferentially with respect to the outer surface of the generally tubularly shaped anode.

9. A method for laying a pipeline, said method comprising:

(a) providing a supply or iron containing pipe on a reel, said iron-containing pipe having positioned thereon a plurality of generally band-shaped sacrificial anodes at longitudinally spaced apart positions, each said band-shaped sacrificial anode having a longitudinal axis and sized to have a distance "r" between said longitudinal axis and an outer surface of said band-shaped sacrificial anode and a length as measured parallel to said longitudinal axis which is in the range of 1r to 20r;

(b) unreeling said iron-containing pipe;and (c) positioning the unreeled iron-containing pipe having the anodes positioned thereon along a pipeline pathway.

10. A method as in claim 9 wherein the plurality of band-shaped sacrificial anodes contain a metal selected from the group consisting of zinc, aluminum and magnesium, said plurality anodes being cast onto the outer surface of the pipe.

11. A method as in claim 10 wherein the plurality of band-shaped sacrificial anodes are each characterized by at least one generally circumferentially extending groove in the exterior surface of the band-shaped sacrificial anode which causes stress concentration along the groove during the unreeling of the iron-containing pipe.

12. A method as in claim 11 further comprising cracking at least some of the band-shaped sacrificial anodes along at least one of said generally circumferentially extending grooves during the unreeling of the iron-containing pipe.

* * * * *